US005806941A

United States Patent [19]

Diederich et al.

[11] Patent Number: 5,806,941

[45] Date of Patent: Sep. 15, 1998

[54] SPRING LATCHED FILE COMPRESSOR

[75] Inventors: Ray Diederich, Whitehouse, Tex.; James Adams, Dyersburg, Tenn.

[73] Assignee: Anderson Hickey Company, Henderson, Tex.

[21] Appl. No.: 807,884

[22] Filed: Feb. 26, 1997

[51] Int. Cl.[6] ..... A47B 63/00

[52] U.S. Cl. ..... 312/183; 220/542; 220/550; 312/348.3

[58] Field of Search ..... 220/534, 541, 220/542, 545, 550, 553, 529; 312/348.3, 319.1, 183, 190, 191, 193, 330.1, 294, 9.56, 9.55, 263

[56] References Cited

U.S. PATENT DOCUMENTS

| | | | |
|---|---|---|---|
| Re. 14,220 | 11/1916 | Ohnstrand . | |
| 1,013,234 | 1/1912 | Straubel . | |
| 1,116,184 | 3/1914 | Weiss . | |
| 1,124,775 | 1/1915 | Martin . | |
| 1,163,373 | 12/1915 | Schmidt . | |
| 1,200,517 | 10/1916 | Ohnstrand . | |
| 1,738,419 | 12/1929 | Burger . | |
| 1,913,137 | 6/1933 | Adler . | |
| 2,043,323 | 6/1936 | Gourley et al. . | |
| 2,081,470 | 5/1937 | Vanderhoof . | |
| 2,153,123 | 4/1939 | Ruck | 220/545 |
| 2,693,192 | 11/1954 | James | 220/534 X |
| 2,761,454 | 9/1956 | Reimer | 220/545 |
| 3,450,304 | 6/1969 | Schreyer | 312/330.1 X |
| 3,499,695 | 3/1970 | Studinski | 312/294 |
| 3,594,056 | 7/1971 | Sager | 312/263 |
| 3,687,326 | 8/1972 | Belknap et al. . | |
| 4,067,630 | 1/1978 | Stark et al. . | |
| 4,648,527 | 3/1987 | Chatterson . | |
| 4,735,324 | 4/1988 | Wilcek . | |
| 4,881,653 | 11/1989 | Norton | 220/542 X |
| 5,111,959 | 5/1992 | Glickman . | |
| 5,312,180 | 5/1994 | Tieder et al. . | |
| 5,366,283 | 11/1994 | Crose . | |

FOREIGN PATENT DOCUMENTS

| | | | |
|---|---|---|---|
| 221067 | 5/1962 | Australia | 312/183 |

*Primary Examiner*—Peter M. Cuomo
*Assistant Examiner*—Janet M. Wilkens
*Attorney, Agent, or Firm*—Flynn, Thiel, Boutell & Tanis, P.C.

[57] ABSTRACT

A longitudinally movable compressor unit for supporting documents in a file drawer. The compressor unit has a document contacting plate extending transversely of the file drawer. A channel extends the width of the plate and has open ends which generally align with longitudinally-extending channels formed in the side walls of the file drawer. A latch extends in and between the channel in the compressor plate and a respective side wall channel at each of the open ends. Each latch has a lug receivable in an aperture on the sidewall channel to selectively latch the compressor unit. A spring or resilient finger is positioned on the latch to bias the latch downwardly to secure the lug in the aperture.

20 Claims, 8 Drawing Sheets

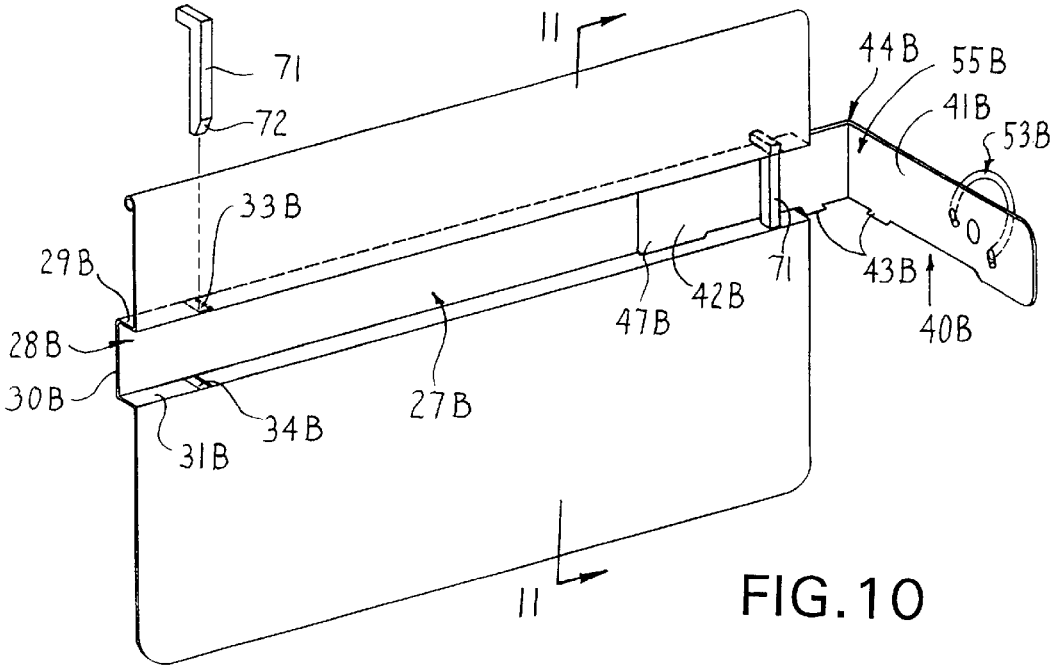
FIG.10
FIG.11
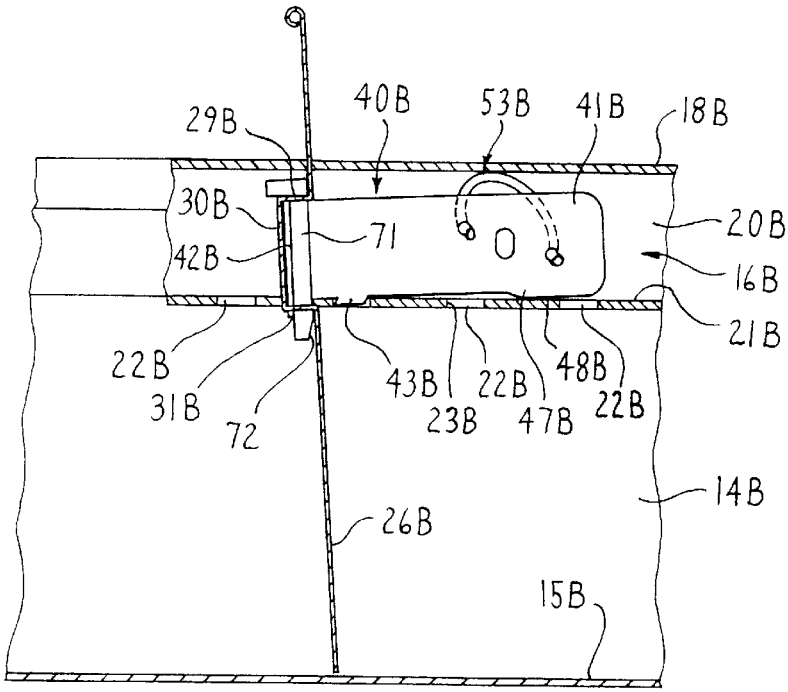

SPRING LATCHED FILE COMPRESSOR

FIELD OF THE INVENTION

This invention relates to an improved file compressor unit for a filing unit such as a shelf or drawer of a file cabinet.

BACKGROUND OF THE INVENTION

Shelves or drawers of a file cabinet conventionally utilize a file compressor unit for maintaining documents in an upright position, particularly when the file drawer is only partially filled with documents. The known compressor units typically employ a vertically enlarged compressor plate positioned adjacent one end of a stack of documents, which compressor plate mounts thereon a manually operable latch mechanism to releasably hold the plate in a selected position longitudinally along the shelf or drawer. This unit typically employs one or more latching members which cooperate with a rack secured to the shelf or drawer, such as along the sides or bottom thereof, to securely hold the compressor plate in a selected position. While such compressor units perform in a satisfactory manner, nevertheless such units require that the drawer or shelf be provided with one or more elongate channels or racks extending longitudinally therealong, which racks are either integrally formed in the wall or are formed by a separate member which is then fixedly secured thereto. Also, many of the latching members are left or right side specific, and this increases the overall cost and complexity of the file unit. Further, some compressor units lack a biasing means for releasably securing the plate in its selected position. Still further, some compressor units are noisy to operate since oftentimes they can be slid along the rack without being completely released and hence create a loud disturbing sound.

In an effort to overcome some of the aforementioned problems, other compressor units have been developed whereby the unit is held in its selected position within the file by a frictional holding force between the compressor unit and the file. To create the frictional holding force, the compressor unit is provided with operable devices for creating a biasing force frictionally preventing movement of the compressor plate, which devices, for example, employ levers and springs. Thus, while the file drawer is simplified, nevertheless this compressor unit is still complex and expensive, and does not always provide a positive holding force.

This invention is directed toward a compressor unit which is believed to represent an improvement over the compressor units which are conventionally utilized. More specifically, the compressor unit of the present invention is of simple construction so that it can be manufactured economically while performing in a satisfactory manner. The compressor unit is also believed to overcome or at least minimize the drawbacks of prior compressor units as briefly explained above.

Examples of prior compressor unit can be found in U.S. Pat. Nos. 1,200,517, RE 14,220, 1,124,775, 4,648,527, 5,111,959, 5,312,180 and 5,366,283.

SUMMARY OF THE INVENTION

In the improved compressor unit of this invention, there is provided a compressor body that has a substantially vertical plate which extends across the file unit and is selectively positionable adjacent one end of a row of documents. The plate mounts a pair of latches thereon each having a portion thereof extending longitudinally along the side wall of the file unit. The longitudinally extending portions are received within channels in the side walls of the file unit. The latches are free of distinct left or right side characteristics so that the same latch advantageously can be used adjacent either side of the file unit. The longitudinally extending portions have lugs extending downwardly for engagement within apertures in the channel. Spring means bias the latches downwardly to resiliently hold the lugs in the apertures to provide a secure placement of the compressor unit. To select the position of the compressor unit, the compressor plate and latches are manually pivoted upwardly against the biasing force of the spring means to remove the lugs from the apertures, and are then slid longitudinally along the file unit until reaching a selected position, for example adjacent the rear of a row of documents. The manual pivoting force is then removed so that the lugs of the compressor latches slide downwardly into corresponding apertures which thereby define the selected position of the compressor unit.

Other objects and purposes of the invention will be apparent to persons familiar with structures of this general type upon reading the following specification and inspecting the accompanying drawing.

BRIEF DESCRIPTION OF THE DRAWINGS

FIG. 10 is a view similar to FIG. 3 but showing a fourth embodiment of a compressor unit according to the present invention; and FIG. 11 is a fragmentary sectional view taken generally along line 11—11 in FIG. 10 and showing the file compressor in its latched position.

Figure 1:
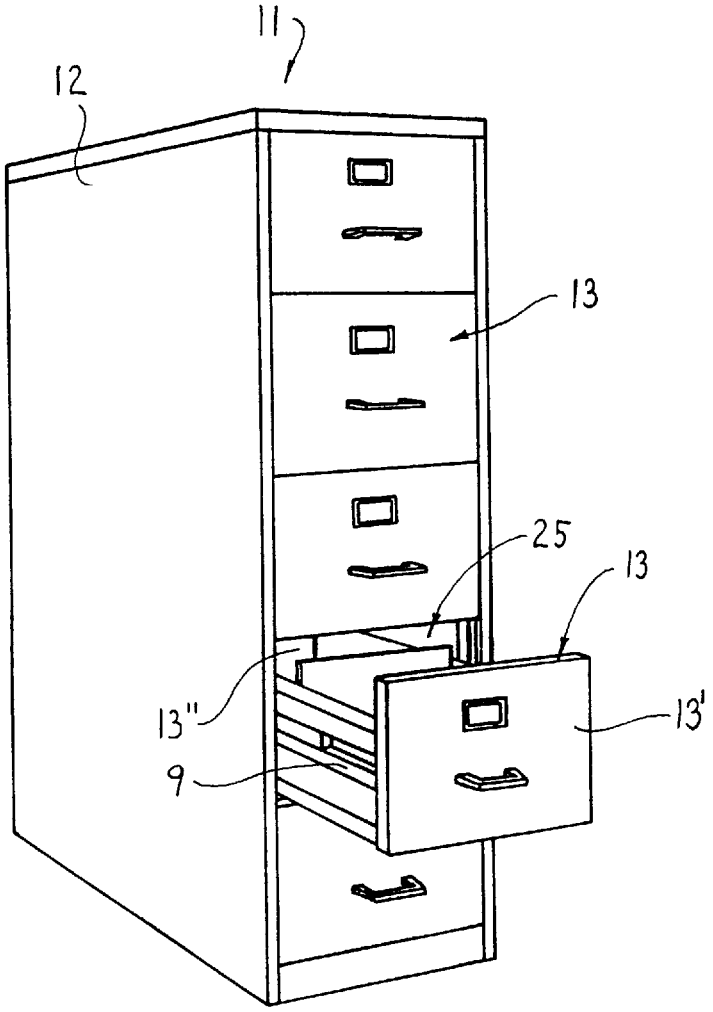
FIG. 1 is a perspective view of a vertical file cabinet with a file compressor shown in an open drawer thereof.

Certain terminology will be used in the following description for convenience and reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the compressor unit and designated parts thereof. Said terminology will include the words specifically mentioned, derivatives thereof, and words of similar meaning.

DETAILED DESCRIPTION

Referring to FIG. 1, there is illustrated a file cabinet 11 of the type commonly referred to as a vertical file. While the following description of the invention describes and illustrates a vertical file, it will be understood that the file compressor of the invention may also be used in other types of file units including lateral files.

The cabinet 11 includes an upright hollow housing 12 in which a plurality of file drawer units 13 are slidably supported by conventional telescoping drawer slides 9 or by conventional telescoping cradles (not shown). The housing 12 has a conventional shape defined by two upright side walls, a rear wall, top and bottom walls, and an open front. The drawer units 13 are received through the open front and move between open and closed positions relative to the housing 12.

A compressor unit 25 (FIGS. 1 and 2) is provided in each drawer unit 13 to hold files therein in an upright position. The compressor unit 25 is longitudinally slidable within the drawer units 13, and is held upright in the interior of the drawer unit 13 by two latches 40 provided adjacent opposite sides of the compressor unit.

Figure 2:
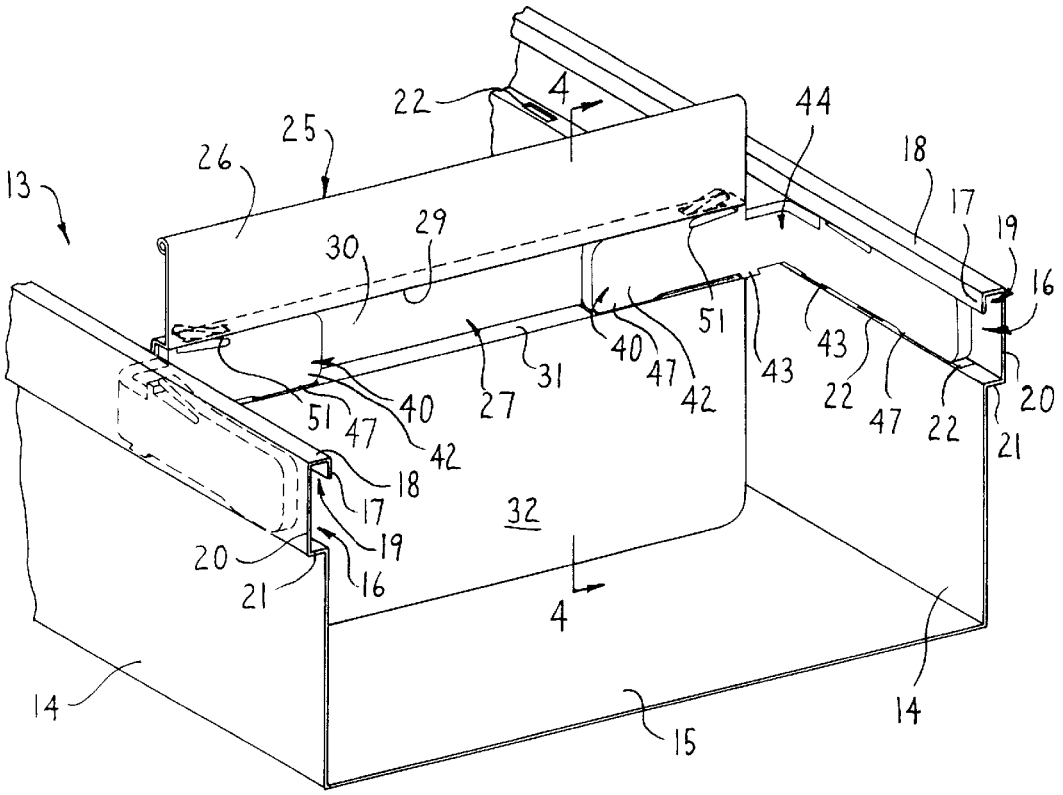
FIG. 2 is a broken perspective view of a file unit with a file compressor according to an embodiment of this invention provided therein.
Figure 3:
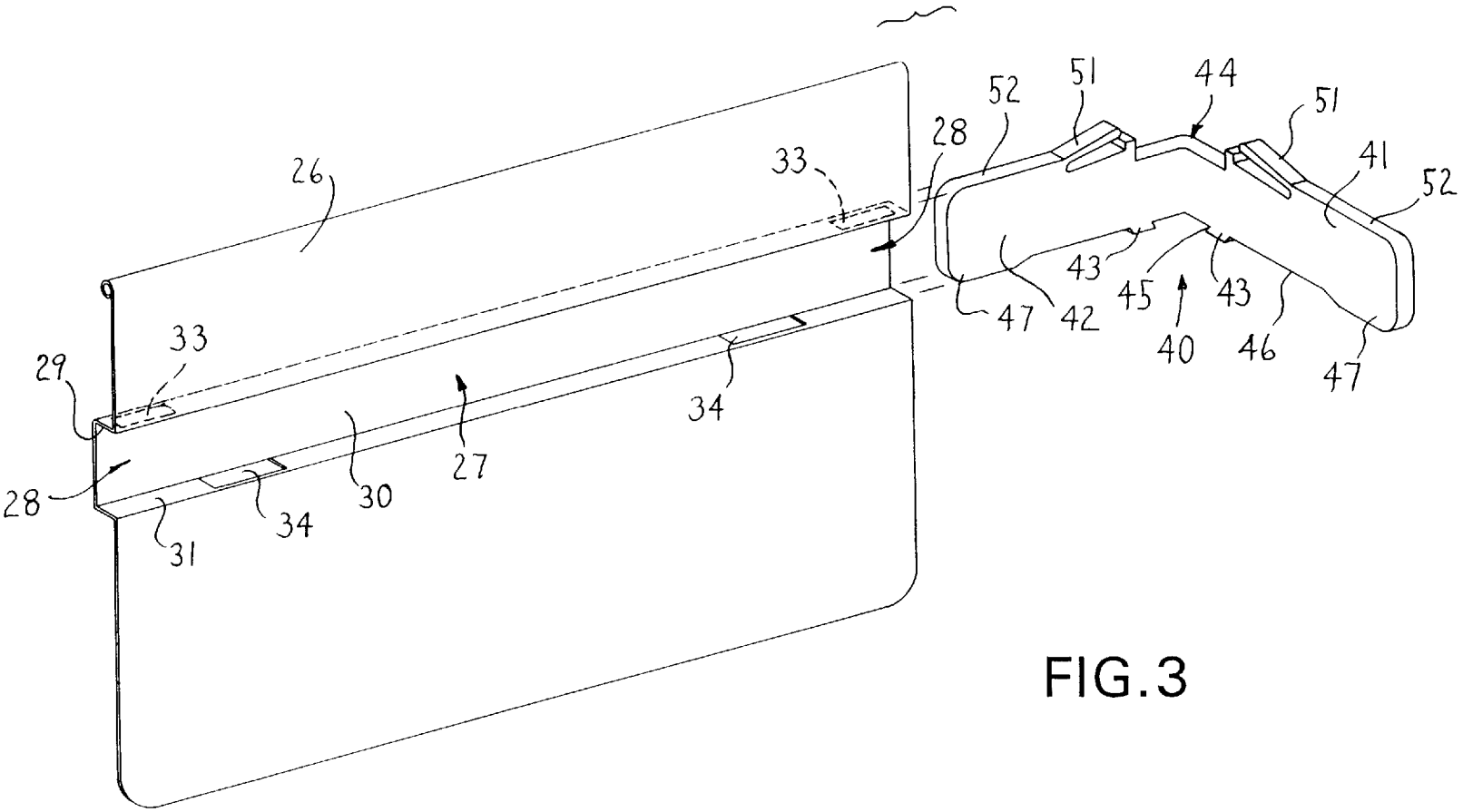
FIG. 3 is an exploded perspective view of the file compressor of FIG. 2 but shown with only one latch provided thereon.

The file drawer unit 13, in the illustrated embodiment of FIG. 2, has a channel-like cross section formed by opposed and generally parallel side walls 14 joined together adjacent the lower edges thereof by a bottom wall 15. The channel-like shape of the drawer unit is closed at opposite ends by a front panel or wall 13' and a rear wall 13". The drawer unit 13 can be of generally conventional construction.

Each side wall 14 is provided with a longitudinally extending channel 16 adjacent the top edge thereof. The channel 16 is integrally formed in the side wall 14, for example by bending or stamping, or a separate channel may be welded to the side wall. The channels 16 have a generally C-shaped cross section so as to open inwardly into the document holding interior of the drawer unit 13. The channel 16 is defined by an upper side wall 18 and a lower side wall 21 which are connected to opposite ends of an intermediate upright web 20. A retaining flange 17 is cantilevered downwardly from an inner free edge of the upper side wall 18. The channel 16 thus defines a track 19 for the compressor latch 40. As shown, the upper side wall 18 defines the top surface of the side wall 14, but the side wall 14 can continue upwardly above the channel 16 to define a deeper drawer unit if desired.

The lower side wall 21 of the channel 16 has a plurality of apertures or openings 22 which open vertically therethrough and are disposed in longitudinally-spaced relation therealong. The apertures 22 in the channel 16 of one side wall 14 are laterally aligned with the apertures 22 in the channel of the other side wall 14. The channel 16 has sufficient lateral depth to receive the compressor latch 40 therein.

To maintain a row of files or documents in an upright position within the drawer unit 13, the present invention provides the compressor unit 25 (FIGS. 2–5) within the drawer interior which is slidable longitudinally of the drawer unit 13 and lockable in selected positions therealong so as to support one end of the row of documents. The compressor unit 25 includes a substantially vertically oriented compressor body or plate 26 sized so as to occupy a substantial extent of the transverse cross-section or width of the drawer unit 13. The compressor body 26 is essentially flat and substantially rectangular in shape. The compressor body 26 can be manufactured out of metal sheet or plastic.

A compressor body channel 27 is formed in and extends horizontally across the compressor body 26 and has open ends 28 at opposite sides of the compressor body 26 which are positioned so as to open directly into the channels 16 in the side walls 14. The channel 27 has respective upper and lower parallel edge walls 29 and 31 each extending transverse to a document engaging face 32 of the compressor body 26. The channel 27 has a vertical rear wall or web 30 which joins the edge walls 29 and 31 and is spaced rearwardly from the face 32. The document engaging face 32 extends generally vertically to define a generally flat surface for engaging the documents and preferably faces forwardly to maintain the documents near the front wall 13' of the drawer 13. A pair of apertures or openings 33 are formed through the upper edge wall 29 adjacent to but spaced a small distance inwardly from the respective open ends 28 of the channel 27. In the preferred embodiment (FIGS. 6–7), the aperture 33 has a slot-shape which opens through the lateral edge of the compressor body 26. A further pair of apertures 34 are formed through the lower edge wall 31, which apertures 34 are laterally offset inwardly relative to the apertures 33 toward the center of the compressor body.

The pair of compressor supports or latches 40 are mounted on the compressor plate 26 adjacent opposite side edges thereof to operatively connect the compressor unit 25 to the file drawer unit 13. In particular, each latch 40 projects sidewardly from the channel 27 and is slidably supported within the respective channel 16 of the drawer side wall 14.

More particularly, each compressor support or latch 40 is generally L-shaped and includes identical elongate legs 41 and 42 which are joined at a common corner 44 and which extend in perpendicular relation with respect to one another. The leg 41 of the right side latch 40 fits in the channel 16 and at least part of the other leg 42 projects into the channel 27 through the open end 28. An upper edge portion of the leg 41 is slidably positioned in the upper part of channel 16 behind the flange 17 so as to retain the latch laterally within the channel 16 while the latch 40 is able to slide longitudinally. The legs 41, 42 are mirror-imaged about the corner 44 such that the latches 40 are not left/right side specific. Herein reference number 41 will refer to the leg of the latch 40 received in channel 16 and reference number 42 will refer to the leg of latch 40 received in compressor body channel 27 without reference to a left or right side latch for ease of description. It will be understood that the leg 42 on a right side latch becomes the leg 41 on a left side latch by rotating the latch 90° about a vertical axis.

A lug 43 is provided on each leg 41, 42 adjacent the corner 44 so as to permit locking of the legs 41 within the respective channels 16. The lugs 43 are cantilevered downwardly from a lower edge 46 of the respective leg of the compressor latch 40. The lugs 43 are dimensioned so that they are receivable in a select one of the apertures 22 in the lower side wall 21 of the channel 16. The lugs 43 are angled slightly toward the corner 44 as they project downwardly so that the lugs 43, when received in the apertures 22, extend slightly beneath the lower side wall 21. The lug 43 thereby has a corner angle 45 (FIGS. 3–7) defined by the rear edge of the lug 43 and the lower edge 46 of the leg 41 which receives the rear edge 23 of the aperture 22 therein.

At the distal or free end of each leg 41, 42 there is provided a downward protuberance 47. The protuberance 47 begins at the free end of the leg 41, 42 and extends longitudinally along the leg 41, 42 toward the corner 44. The protuberance 47 angles upwardly to join the upwardly spaced lower edge 46 and terminates at a point which is spaced apart from the lug 43. The protuberance 47 has a length longitudinally along the leg 41, 42 which is greater than the length of the aperture 22, but less than the length of the aperture 34. This enables the protuberance 47 of leg 41 to slide along the lower side wall 21 of channel 16, whereas the protuberance 47 of the other leg 42 in the compressor unit channel 27 projects downwardly into the aperture 34 to secure the latch 40 to the compressor plate 26. The protuberance 47 on the leg 41 in the channel 16 also provides a pivot or rocking surface 48 for the compressor unit 25 when moving the compressor unit between latched and non-latched slidable positions as explained below.

In the preferred construction, the compressor latch 40 is preferably constructed in one piece of a plastic and includes a resilient cantilevered finger 51 projecting upwardly from the upper edge 52 of each leg 41, 42. Generally, the finger 51 on leg 41 acts as a spring means, whereas the finger 51 on the other leg 42 acts as a latch.

More particularly, the cantilevered finger 51 has its base end joined to the upper edge 52 of leg 41, 42 intermediate the longitudinal length thereof. The finger is elongated away from its base end and projects toward the corner 44 as it angles upwardly until terminating at a free end which is disposed approximately vertically above the respective lug 43.

The resilient finger 51 on the leg 41 as positioned in the channel 16 extends upwardly behind the flange 17 and presses against the upper side wall 18 to resiliently bias the corner 44 of the compressor latch 40 downwardly to hold the lug 43 in the selected aperture 22 in the lower side wall 21 of the channel 16, thereby latching the compressor unit 25 in the selected position.

The resilient finger 51 on the other leg 42 projects into the aperture 33 in the compressor channel 27. Thus, the engagement of the finger 51 upwardly in the aperture 33, along with the engagement of the protuberance 47 downwardly in the aperture 34, secures one leg (i.e., leg 42 in FIG. 3) in the compressor channel 27.

The lug 43 on the leg 42 which projects into channel 27 of the compressor plate 26 effectively acts as a stop and abuts the end edge of the bottom wall 31 so as to limit the insertion of the leg into the channel 27.

Figure 5:
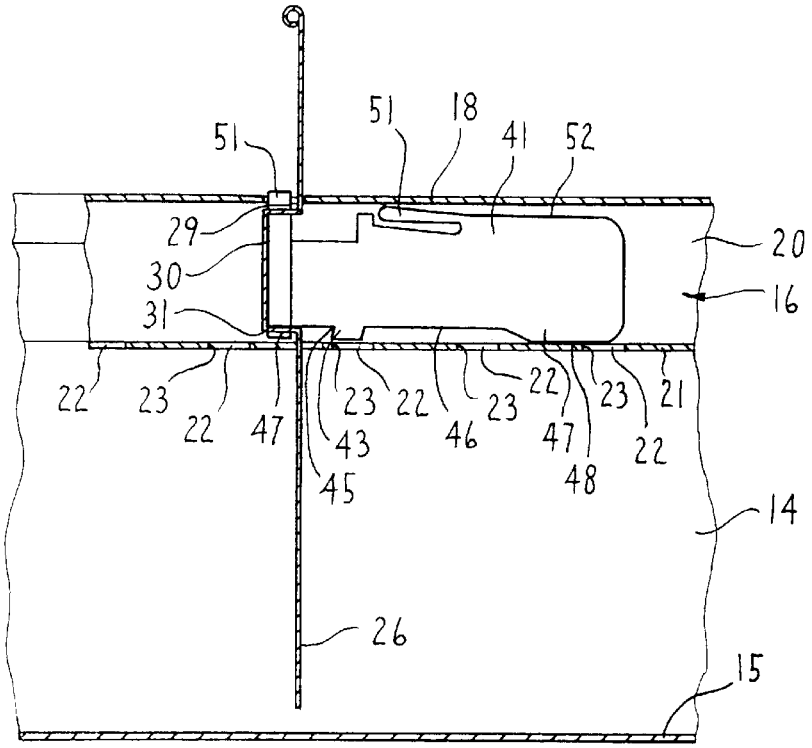
FIG. 5 is a view like FIG. 4 but showing the file compressor in its slidable position.
Figure 6:
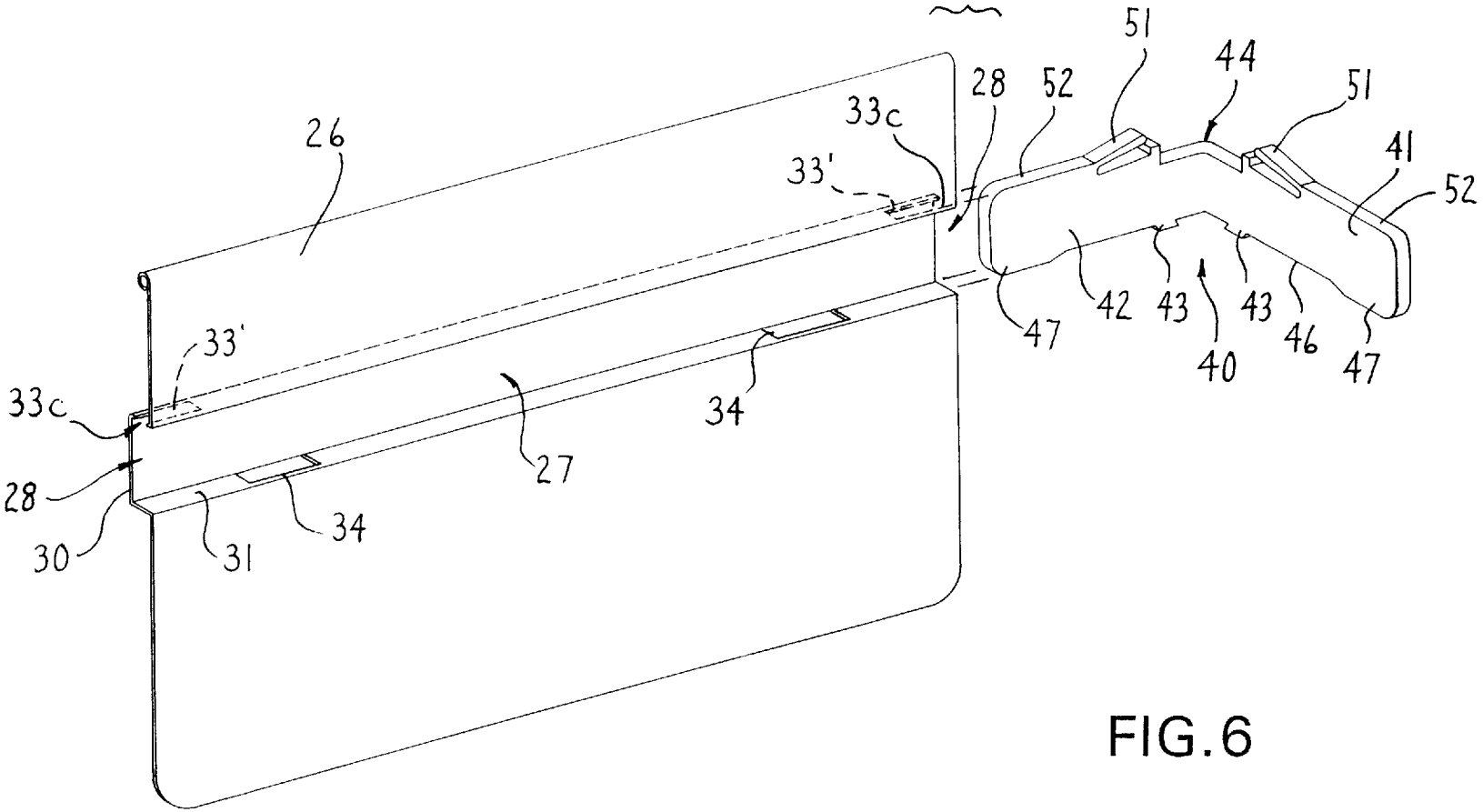
FIG. 6 is a view similar to FIG. 3 but showing a second and preferred embodiment of the file compressor of this invention.
Figure 7:
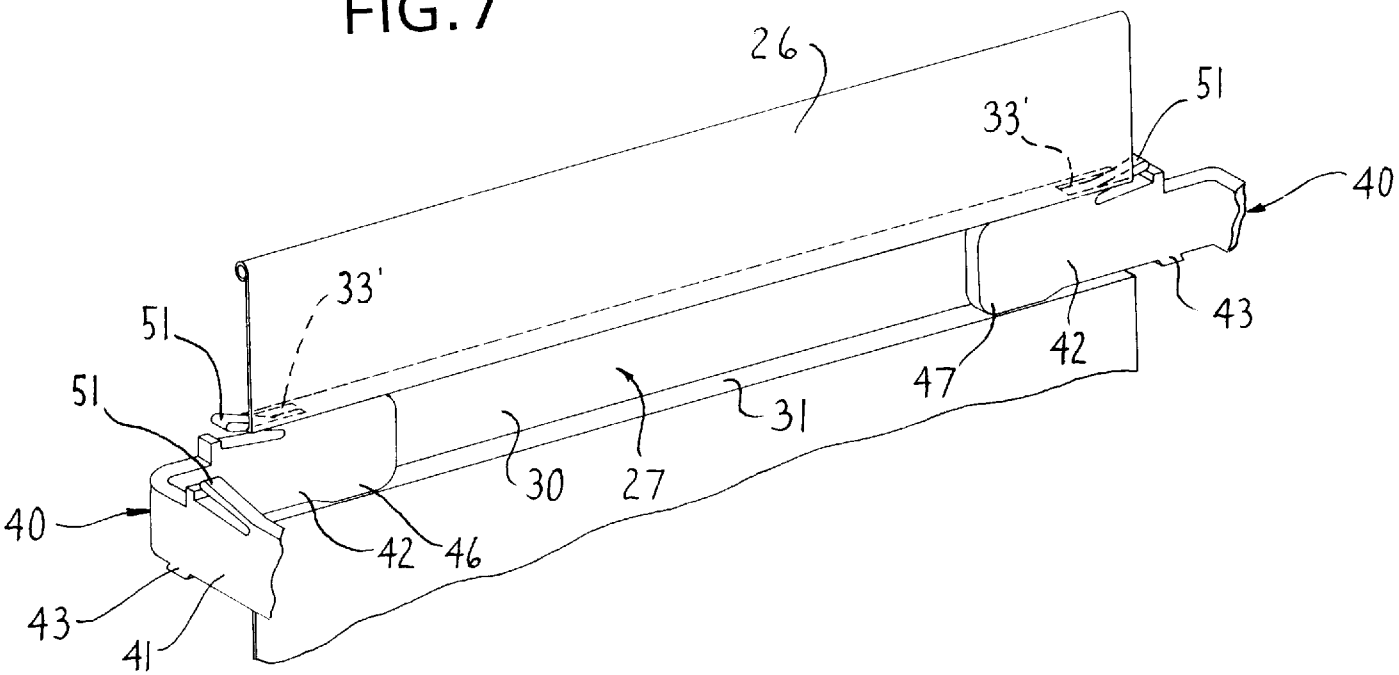
FIG. 7 is a fragmentary view of the file compressor of FIG. 6 of this invention.

Referring now to FIGS. 6 and 7, there is illustrated a preferred embodiment of the compressor unit 25. The compressor unit 25 of FIGS. 6 and 7 is the same as described above relative to FIGS. 2–5 except that the aperture 33' is formed as an elongate slot which opens outwardly through the side edge of the body 26. The slot 33' thus has an open end 33C which opens toward the lateral side edge of the compressor body 26. The finger 51 on the leg 42 of latch 40 extends upwardly into the slot-shaped aperture 33 to secure the one leg in the compressor channel 27. The slot-shaped aperture 33 allows the finger 51 to extend past the lateral edge of the compressor plate 26.

OPERATION

The operation of the spring latched file compressor (FIGS. 2–7) will be described below to ensure a complete understanding thereof.

Figure 4:
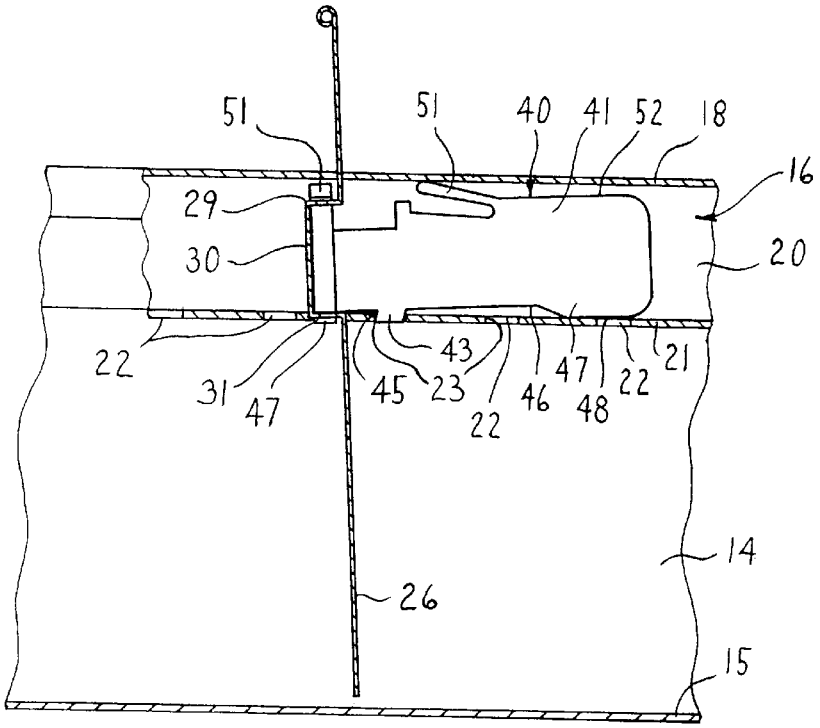
FIG. 4 is a fragmentary sectional view taken generally along line 4—4 in FIG. 2 and showing the file compressor in its latched position.

The compressor unit 25 will normally be maintained in a latched position as illustrated in FIGS. 2 and 4, in which position the spring means, here the resilient fingers 51 on the legs 41 disposed within the channels 16, press against the upper side walls 18 of the channel 16. The resilient fingers 51 force the rear portions of the respective legs adjacent corners 44 downwardly toward the lower side walls 21 so that the lugs 43 are supported into and held in select ones of apertures 22. In this latched position, the compressor body 26 may contact the end-most document in the file unit 13 to provide a supportive backing to hold the documents upright in the file unit 13.

When it is desired to release and reposition the compressor unit 25, the compressor body 26 is gripped by a user, for example by the curled flange at the top of the compressor body or by the rear of the channel 27 and is displaced upwardly away from the bottom wall 15 of the file unit 13. The upward movement of the compressor unit 25 is not only against the weight of the compressor unit 25 and any frictional contact between the compressor unit 25 and the documents, but also against the downward biasing force of the resilient fingers 51 acting against the upper side walls 18 of the channels 16. This causes the compressor unit 25 to move into an unlatched or slidable position as shown in FIG. 5, wherein the resilient fingers 51 resiliently deflect downwardly and the lugs 43 are removed from the selected apertures 22. During the upward releasing movement, the compressor unit 25 pivots about the pivot or rocker surface 48 on the protuberance 47 until the respective leg 41 itself contacts the upper side wall 18 or the resilient finger 51 deflects into contact with the upper edge of the respective leg. Thus, the distal end of the protuberance 47 farthest from the corner 44 will be the sole portion of the latch 40 contacting the lower side wall 21 of channel 16. Alternatively, during the upward releasing movement, the entire compressor unit 25 is raised so that the lug 43 is removed and the resilient finger 51 is deflected whereby the leg 41 does not contact the lower side wall 21 of the channel 16.

With the compressor unit 25 in its unlatched position, the compressor unit can then be slidably moved longitudinally along the drawer unit to a selected location. When the compressor unit 25 reaches its selected location, the user manually releases the compressor unit 25 and the resilient fingers 51 force the rear corners 44 of the latches 40 downwardly away from the upper walls 18 of channels 16. If the lugs 43 are not aligned with the aperture 22, then the compressor unit 25 is moved slightly forwardly or rearwardly of the drawer unit so that the lugs 43 align with and are urged downwardly into one of the plurality apertures 22.

With the improved latch 40 of this invention as described above, the two latches 40 mounted adjacent the right and left sides of the compressor plate 26 are identical since the two legs 41 and 42 are identical, whereby only a single latch member 40 is required for manufacture and such latch member is mountable on either side of the compressor body.

MODIFICATIONS

Figure 8:
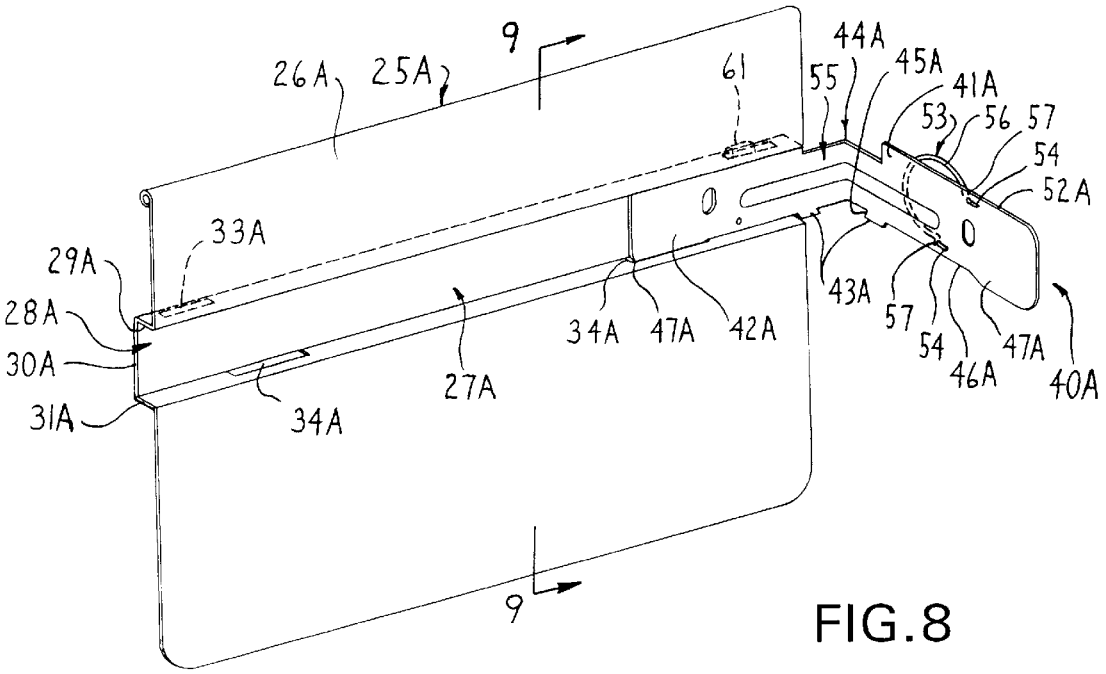
FIG. 8 is a view similar to FIG. 3 but showing a third embodiment of a file compressor according to the present invention.
Figure 9:
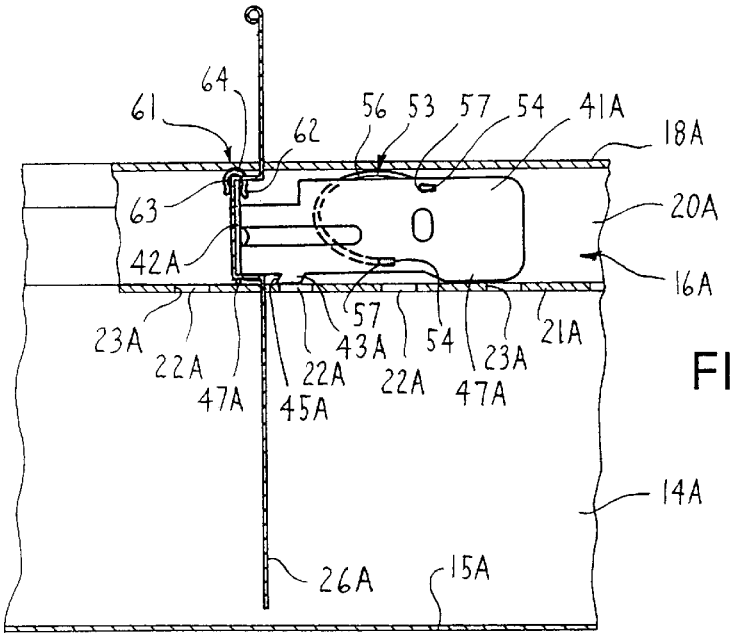
FIG. 9 is a fragmentary sectional view taken generally along line 9—9 in FIG. 8 and showing the file compressor in its slidable position.

FIGS. 8 and 9 illustrate a modified compressor latch 40A which is similar to the latch 40 of FIGS. 2–7 described above, and accordingly parts of latch 40A which generally correspond to the latch 40 and the surrounding compressor unit and drawer structure are designated by the same reference numerals with a suffix "A" added thereto.

The latch 40A has an L-shaped body portion 55 with legs 41A and 42A. Similar to the above described embodiment, the legs 41A, 42A are symmetrical about corner 44A with one leg being transverse to the other. A spring 53 is attached to the leg 41A received in the channel 16A through laterally and vertically offset holes 57 in the leg 41A. The holes 57 are placed in both legs 41A, 42A so that the L-shaped body portion 55 is not left or right side specific. By simply rotating the L-shaped body portion 55 by ninety degrees about a vertical axis and attaching the spring 53 to leg 41A which is to be inserted into channel 16A, then the latch 40A can be mounted to either the left or right side of the drawer unit 13.

Thus the mounting of the spring 53 determines the left or right side mounting of the latch 40A.

The spring 53 has a bowed, U-shaped section 56. At the ends of the bowed section 56 are laterally offset end sections 54. The end sections 54 are adapted to be received through the holes 57 to thereby secure the springs 53 to the leg 41A such that the spring 53 projects upwardly above the leg 41A. The bowed sections 56 of the spring 53 which are attached to the legs 41A of the right and left side latches 40A thereby contact and press against respective upper side walls 18A to bias the legs 41A downwardly and resiliently secure the lugs 43A in select apertures 22A in channels 16A.

The L-shaped body portion 55 is narrower or thinner than the first mentioned latch 40 with the finger 51 integrally connected thereto. The L-shaped body portion 55 only occupies the part of the depth of channel 16A adjacent the outer channel wall 20A so that the end portions 54 of the spring extending inwardly through the holes 57 do not undesirably engage or snag a document therein while moving the compressor 25A or a document.

The L-shaped body portion 55 is preferably stamped or pressed out of metal. The spring 53 is also preferably metal, in particular steel.

As the latch 40A lacks the finger on the leg 42A, a different connection or latch means for securing the leg 42A of latch 40A within the compressor channel 27A must be provided. As discussed above, the protuberance 47A is received by aperture 34A in the lower edge wall 31A. However, a symmetrical inverted U-shaped, resilient clip 61 with two arms 62, 63 joined by a web 64 is provided to secure the leg 42A in the compressor body channel 27A. The clip 61 is commonly referred to as a Timmerman or "V" clip. The clip 61 has one arm 62 received in the aperture 33A of the upper edge wall 29A of the channel 27A and it extends downwardly therethrough to contact the forward facing surface of the leg 42A facing into the document receiving portion of the file unit 13. The web 64 extends over the upper surface 52A of latch 40A and the width of the compressor body 26A. The other arm 63 contacts and extends along the rear surface of the compressor body 26A, specifically the rear of the channel 27A. Thus the clip 61 resiliently presses the leg 42A against the channel 27A between arms 62, 63 to secure the leg 42A therein along with the protuberance 47A being received in aperture 34A.

FIGS. 10 and 11 illustrate a further modified compressor latch 40B which is similar to the latch 40A of FIGS. 8 and 9 described above, and accordingly parts of latch 40B which generally correspond to latch 40A and the surrounding compressor unit and drawer structure are designated by the same reference numeral with a suffix "B" added thereto.

The latch 40B also has an L-shaped body portion 55B with a spring 53B attached to the leg 41B received in the channel 16B. The L-shaped body portion 55B is not left or right side specific until the spring 53B is mounted on the leg 41B. The structure of the latch 40B is essentially identical to the above modified latch 40A, but a different securing means is used to secure the leg 42B in the channel 27B.

More particularly, a wedge 71 secures the leg 42B in the channel 27B by pinning the leg 42B against the rear wall 30B of the channel 27B. In this embodiment, the apertures 33B and 34B have the same size and shape and are vertically aligned one with respect to the other. The wedge 71 is received by and extends through the aperture 33B in the upper side 29B of the channel 27B past the leg 42B into the vertically aligned aperture 34B in the lower edge wall 31B of the channel 27B. The wedge 71 has an inclined surface 72 at the lower end thereof so that, as the wedge 71 is forced into the aperture 34B, the inclined surface 72 engages a side thereof and forces the wedge 71 toward the rear wall 30B of the channel 27B, thereby pinning the leg 42B of the compressor bracket 40B therebetween.

The modified embodiments in FIGS. 8–11 operate substantially the same as the compressor unit 25 (FIGS. 2–5) with the springs 53 and 53B performing the same function as the resilient fingers 51.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In combination, a file unit having an upright wall, and a compressor unit positioned on the file unit and selectively movable longitudinally therealong;

said upright wall including a first channel fixedly associated therewith and extending longitudinally therealong, said first channel being accessible from said file unit through a longitudinally extending opening, said first channel having a plurality of first apertures in a lower wall thereof; and said compressor unit including a compressor body positioned on and extending transversely of said file unit, said compressor body having a second channel positioned therein and having an open end which opens into and transversely intersects said first channel;

said compressor unit including a compressor latch of a generally L-shaped configuration and defining first and second transverse legs, said second leg being received in said second channel, said first leg of said compressor latch being received in said first channel, said first leg having a lug receivable in a select one of said first apertures and a spring means for resiliently urging said lug into said respective first aperture.

2. The combination according to claim 1, wherein said second channel has a second aperture in a lower edge wall thereof, and wherein said second leg has a protuberance receivable in said second aperture.

3. The combination according to claim 2, wherein said second leg has a latch means for securing said second leg in said second channel.

4. The combination according to claim 3, wherein said spring means is a resilient cantilevered finger extending from an upper edge of said first leg.

5. The combination according to claim 4, wherein said latch means is a resilient cantilevered finger extending from an upper edge of said second leg.

6. The combination according to claim 5, wherein said first and second legs are joined at a corner, wherein said protuberance of said second leg is positioned at an end of said second leg distal said corner, wherein a further protuberance is provided on an end of said first leg distal said corner, and wherein said lug is positioned between said further protuberance and said corner on a lower edge of said first leg.

7. The combination according to claim 6, wherein said second leg has a lug positioned on a lower edge thereof, and wherein said first and second legs are symmetrical about said corner.

8. The combination according to claim 6, wherein said further protuberance has a length longer than a length of one of said plurality of first apertures.

9. The combination according to claim 1, wherein said first channel is at least as deep as said first leg is wide.

10. The combination according to claim 1, wherein said spring means is a generally U-shaped spring extending above an upper edge of said first leg.

11. The combination according to claim 10, wherein said first leg has holes therein, and wherein said spring has laterally displaced ends, said laterally displaced ends being receivable in said holes of said first leg to secure said spring to said first leg.

12. The combination according to claim 11, wherein said second channel has a second aperture therein, and wherein said compressor unit includes a clip having two arms, one of said arms being received in said second aperture and contacting one side of said second leg, the other of said arms contacting a rear surface of said second channel, and said clip resiliently holding said second leg against said second channel between said two arms.

13. The combination according to claim 11, wherein said second channel has a second aperture and a plurality of third apertures therein and wherein said compressor unit includes a wedge, said wedge being received in said second aperture and one of said plurality of third apertures to press said second leg against said second channel to hold said second leg therein.

14. A file drawer, comprising:

an elongate bottom wall joining two laterally-spaced elongate sidewalls defining an open interior, said sidewalls each having a sidewall channel positioned thereon, said sidewall channels opening into said open interior, said sidewall channels having a plurality of apertures therein;

a transversely extending compressor body positioned in said interior for holding documents upright in said interior;

first and second L-shaped latches secured to said compressor body and extending outwardly therefrom, said first and second L-shaped latches each having an outer leg slidably received in a respective one of said sidewall channels and extending longitudinally thereof, each of said outer legs having a lug cantilevered therefrom and adapted to be received in a select one of said apertures; and a spring connected to each of said outer legs and contacting a respective said sidewall channel to bias the respective lug in said select aperture.

15. The file drawer according to claim 14, wherein each of said first and second L-shaped latches has an inner leg secured in a second channel in said compressor body, said outer and inner legs of each L-shaped latch being joined at and generally symmetrical about a corner.

16. The file drawer according to claim 15, wherein said second channel has a plurality of upper and lower apertures, wherein said inner and outer legs each have a protuberance distal said corner on a lower side thereof, said protuberances on said inner legs being received respectively in one of said lower apertures, said protuberance on each said outer leg being dimensioned to slide within the respective sidewall channel and being larger than said apertures in the respective sidewall channel, and wherein a latch means is provided to secure each said inner leg in said second channel.

17. The file drawer according to claim 16, wherein said latch means and said spring are resilient fingers cantilevered from each of said first and second latches.

18. The file drawer according to claim 16, wherein said latch means is a pair of clips received in said upper apertures to secure said inner legs in said second channel.

19. The file drawer according to claim 15, wherein said first and second latches are identical one-piece members which are separable from said compressor body.

20. A file drawer comprising:

an elongate bottom wall joining two laterally-spaced elongate sidewalls defining an interior of the file drawer, said sidewalls each having a sidewall channel positioned thereon, said sidewall channels having a plurality of apertures therein;

a compressor body extending transversely of said bottom wall and said sidewalls in said interior;

first and second one-piece supports connecting said compressor body to said sidewall channels, said first and second one-piece supports each having first and second legs joined at a corner, said first and second legs being substantially identical, each of said first legs having a lug protruding therefrom and adapted to be received in one of said apertures; and a spring connected to each of said first legs to urge the respective said lug into one of said apertures.

* * * * *